US006497260B2

(12) United States Patent
Hennan et al.

(10) Patent No.: US 6,497,260 B2
(45) Date of Patent: Dec. 24, 2002

(54) QUICK CONNECT FILL SYSTEM

(75) Inventors: John Hennan, Carver, MN (US); Ray Wolf, Chaska, MN (US)

(73) Assignee: Entegris, Inc., Chaska, MN (US)

( * ) Notice: Subject to any disclaimer, the term of this patent is extended or adjusted under 35 U.S.C. 154(b) by 0 days.

(21) Appl. No.: 09/867,370

(22) Filed: May 29, 2001

(65) Prior Publication Data

US 2002/0092582 A1 Jul. 18, 2002

Related U.S. Application Data

(60) Provisional application No. 60/207,906, filed on May 29, 2000.

(51) Int. Cl.[7] ..... B65B 3/00
(52) U.S. Cl. ..... 141/384; 141/59
(58) Field of Search ..... 141/59, 383, 384, 141/386

(56) References Cited

U.S. PATENT DOCUMENTS 3,777,789 A 12/1973 Corlet

*Primary Examiner*—Charles R. Eloshway
*Assistant Examiner*—Peter deVore
(74) *Attorney, Agent, or Firm*—Patterson, Thuente Skaar & Christensen

(57) ABSTRACT

In a preferred embodiment, a quick connect adaptor has a first coupling that attaches to the bung of a plastic blow molded drum by way of pivotal retainer members and a second coupling that connects to a conventional dispense head. The bung has internal or external threads and may have a radially extending circumferential lip or other retainer member engagement structure. The first coupling provides a secure attachment that is quickly accomplished by manual operation. In a preferred embodiment, the pivotal retaining members pivot into and out of a retention position with the radially and circumferential extending lip. The retaining members are mechanically linked with a circular manual handle member to operate the pivoting of said plurality of retaining members. The pivotal members are preferably biased toward the retention position. These couplings will generally utilize O-rings for sealing.

20 Claims, 6 Drawing Sheets

QUICK CONNECT FILL SYSTEM

This application claims priority to the Provisional Application No. 60/207,906 filed May 29, 2000, and hereby incorporates said application herein.

BACKGROUND OF THE INVENTION

This invention relates to bulk containers and equipment for receiving, transportation and dispensing of fluids. More particularly, the invention relates to systems for efficiently transferring highly corrosive fluids with respect to said drums.

Steel and plastic drums are utilized in many industries for transporting and storing various liquids which may be utilized as fuels, lubricants, ingredients, process fluids, or the like. In the majority of applications where fluids are transported and stored in drums, slight spills, although not desireable, are usually not hazardous to personnel nor of great concern.

In certain industries, for example, the semiconductor processing industry, extremely caustic and ultrapure chemicals such as hydrofluoric, sulfuric, and hydrochloric acids are commonplace and are transported and stored in such drums. Total and absolute containment during storage, transport, and handling are essential for protection of personnel and the environment. These chemicals require handling with materials that are chemically inert, that do not degrade from contact, and do not contaminate the chemicals. Chemically inert materials such as fluoropolymers, for example, PFA(perfluoroalkoxy) and PTFE (polytetrafluoroethylene) have been found to be suitable for contact with these ultra pure, highly corrosive, and toxic chemicals. Even when drums with such hazardous and caustic liquids are on-site and ready for use, great care must be taken in accessing the liquids so as not to expose personnel or the environment to such chemicals. Couplings used in making fluid connections must provide an extremely high level of containment integrity. Moreover, it is desireable to minimize the time and thus potential exposure that personnel have to these materials.

Plastic drums utilized in the semiconductor processing industry typically have standardized openings on the top of the drums. These openings comprise a pair of ports or bungholes, each having a fitting with a neck extending upward from the top wall of the drum approximately 1 to 1½ inches. The ports may have internal or external threads. Several closures or bungs may be utilized with these standardized ports including standard bung closures which are threadably attached to the neck and utilize O-rings for sealing.

Access to the liquids in the plastic drums is typically accomplished by port bung connectors known as dispense heads that attach to drum inserts such as disclosed in U.S. Pat. No. 4,699,298, issued to Grant et al., and assigned to FSI International Corporation and as disclosed in U.S. Pat. No. 5,108,015, issued to Rauworth, and assigned to Fluorware, Inc. Also, see the dispense heads and closures as shown in U.S. Pat. Nos. 6,045,000 and 6,079,547. These four patents are hereby incorporated herein by reference. The bung connectors illustrated in these patents may have drum inserts with down hole tubes extending to the inside bottom of the drums for withdrawing the liquid in the drum and for providing a means for sensing the level of the liquid in the drum. An additional tube or port in the insert may be utilized for supplying air or other gas to replace the liquid as it is withdrawn or to allow escape of gas/air when the drum is filled. Although such dispense heads can and are used for filling the drums, such heads are not ideal for such use in that they take some time to attach to the drum bung. Where rapid filling of drums is needed such as at a chemical distribution facility, a coupling that attaches quicker and easier is desirable.

SUMMARY OF THE INVENTION

In a preferred embodiment, a quick connect adaptor has a first coupling that attaches to the bung of a plastic blow molded drum by way of pivotal retainer members and a second coupling that connects to a conventional dispense head. The bung has internal or external threads and may have a radially extending circumferential lip or other retainer member engagement structure. The first coupling provides a secure attachment that is quickly accomplished by manual operation. In a preferred embodiment, the pivotal retaining members pivot into and out of a retention position with the radially and circumferential extending lip. The retaining members are mechanically linked with a circular manual handle member to operate the pivoting of said plurality of retaining members. The pivotal members are preferably biased toward the retention position. These couplings will generally utilize O-rings for sealing.

A feature and advantage of the invention is that the coupling of the fluid flow lines may be accomplished with minimal manual motion, such as a ⅛ of a turn of the handle, as opposed to several rotations of a conventional coupling.

A further feature and advantage is that drums may be filled in much less time than when utilizing conventional couplings.

A further feature and advantage is that the adaptor is relatively small, has a minimal number of components, and, other than O-rings, only one component is wetted by the fluids being handled.

DETAILED DESCRIPTION OF PREFERRED EMBODIMENTS

Figure 1:
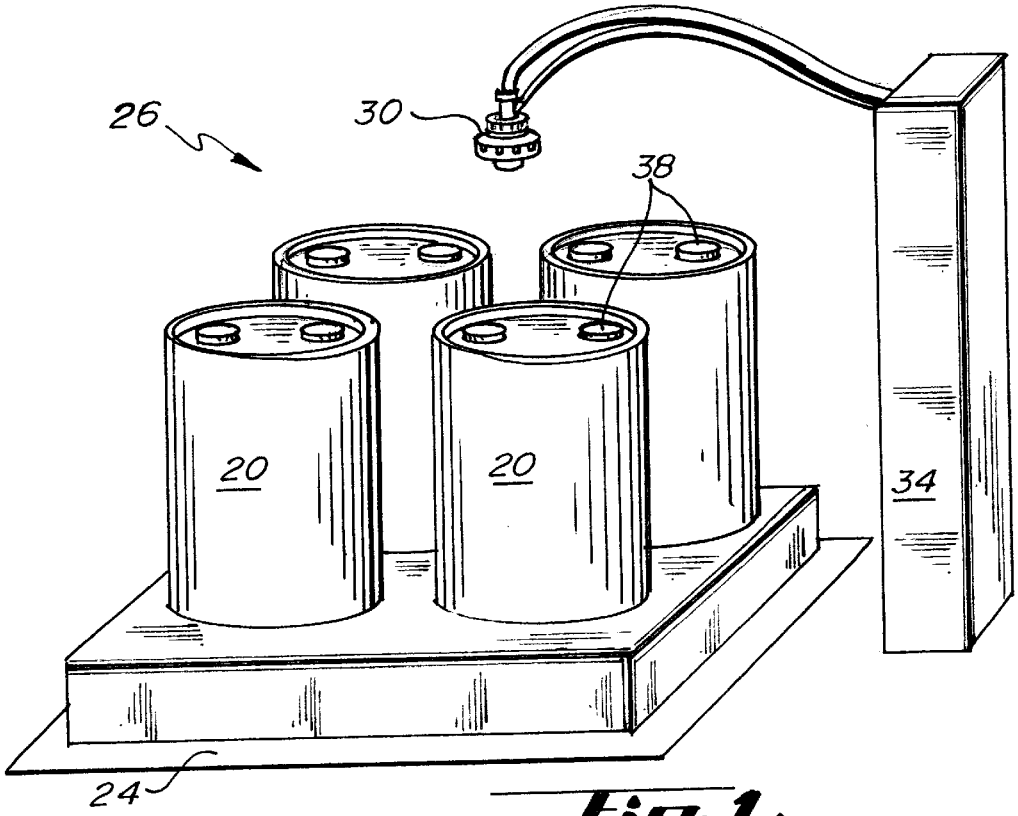
FIG. 1 is a perspective view of a chemical distribution fill station embodying the invention herein.

Referring to FIG. 1, four plastic drums 20, such as utilized in the chemical processing industry, are shown on a pallet 22, on a scale 24, ready for filling at a fill station 26. A fill coupling 30 is connected to a fluid distribution source 34 for filling the drums. The drums have closures 38 thereon that are removed for filling and thereafter replaced for shipping. The drums are suitably secured to the pallet for shipping.

Figure 2:
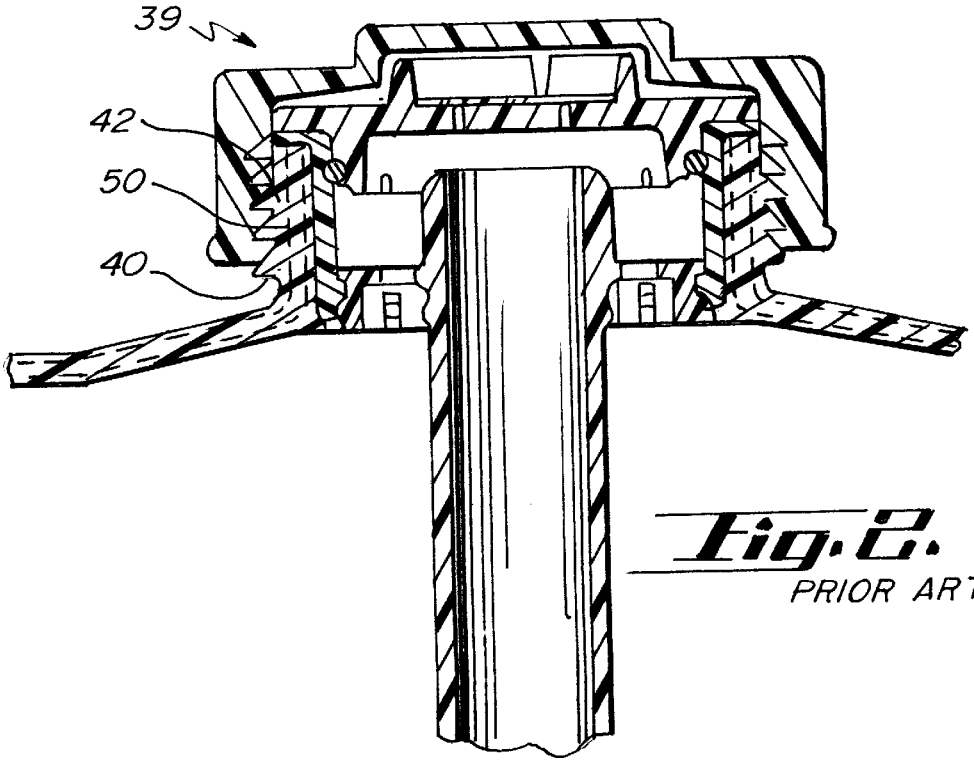
Fig. 2. PRIOR ART
FIG. 2 (prior art) is a cross-sectional view of a conventional bung and closure.
Figure 3:
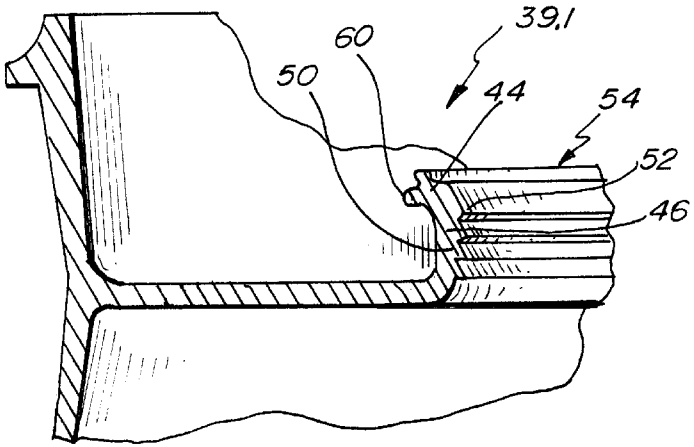
fig. 3. PRIOR ART
FIG. 3 (prior art) is a cross-sectional view of a conventional bung.
Figure 5:
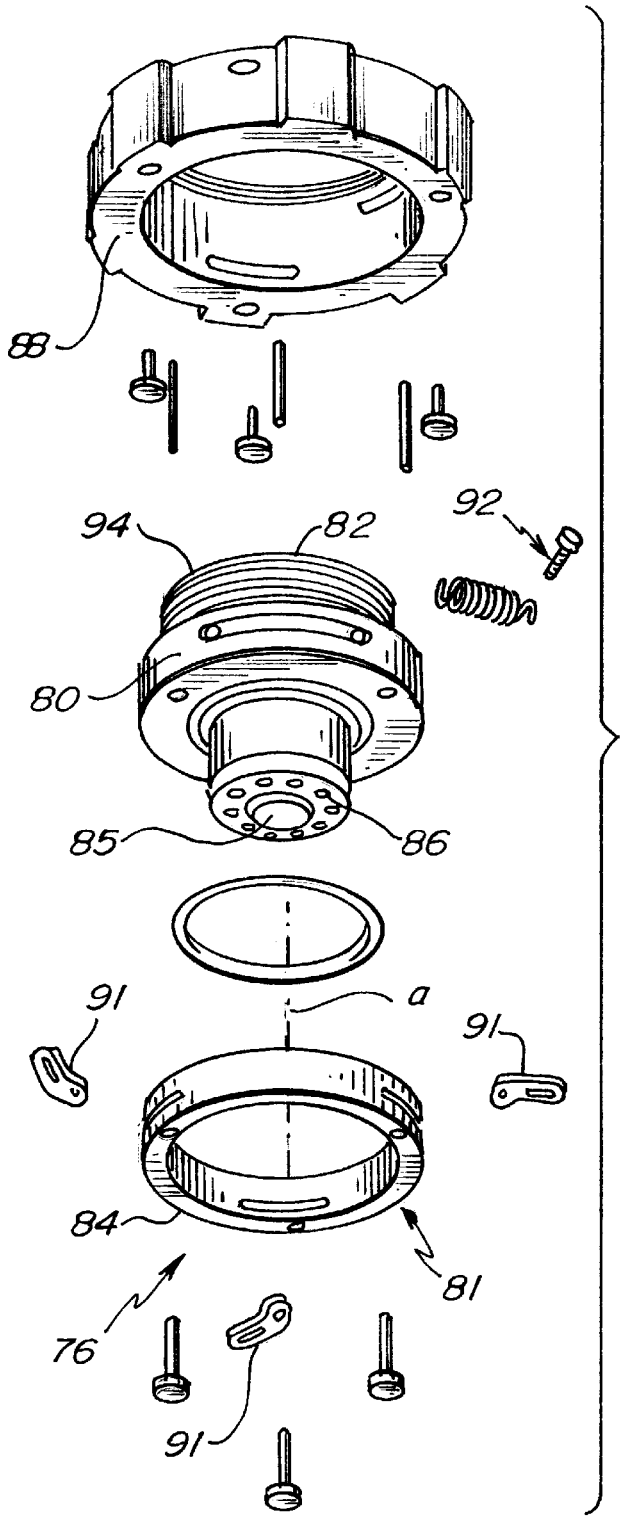
FIG. 5 is an exploded view of an adaptor in accord with the invention.

Referring to FIGS. 2 and 3, prior art exemplary bungs 39, 39.1 are illustrated in cross-section, one 40 with external threads 42 and one 44 with internal threads 46. Each bung has a neck 50, threaded portion 52, and bung opening 54. The bung of FIG. 3 has a lip 60 which extends radially outward and circumferentially with respect to the bung. The lip 60 constitutes alternate structure to threads for making the mechanical connection to the coupling. The lip may also be utilized for sealing functions.

Figure 4:
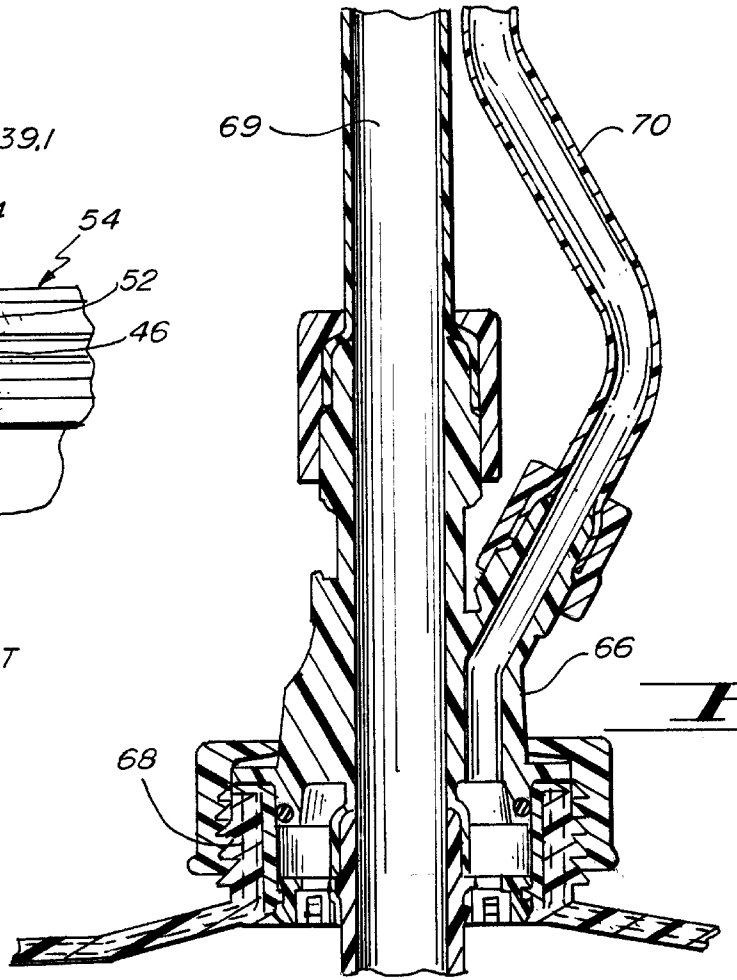
fig. 4. PRIOR ART
FIG. 4 (prior art) is a cross-sectional view of a dispense head on a bung.

Referring to FIG. 4, a prior art exemplary coupling configured as a dispense head 66 is illustrated attached to a bung 68. Such dispense head has a pair of conduits including a fluid flow conduit 69 and an air displacement/replacement conduit or vent 70.

Figure 6:
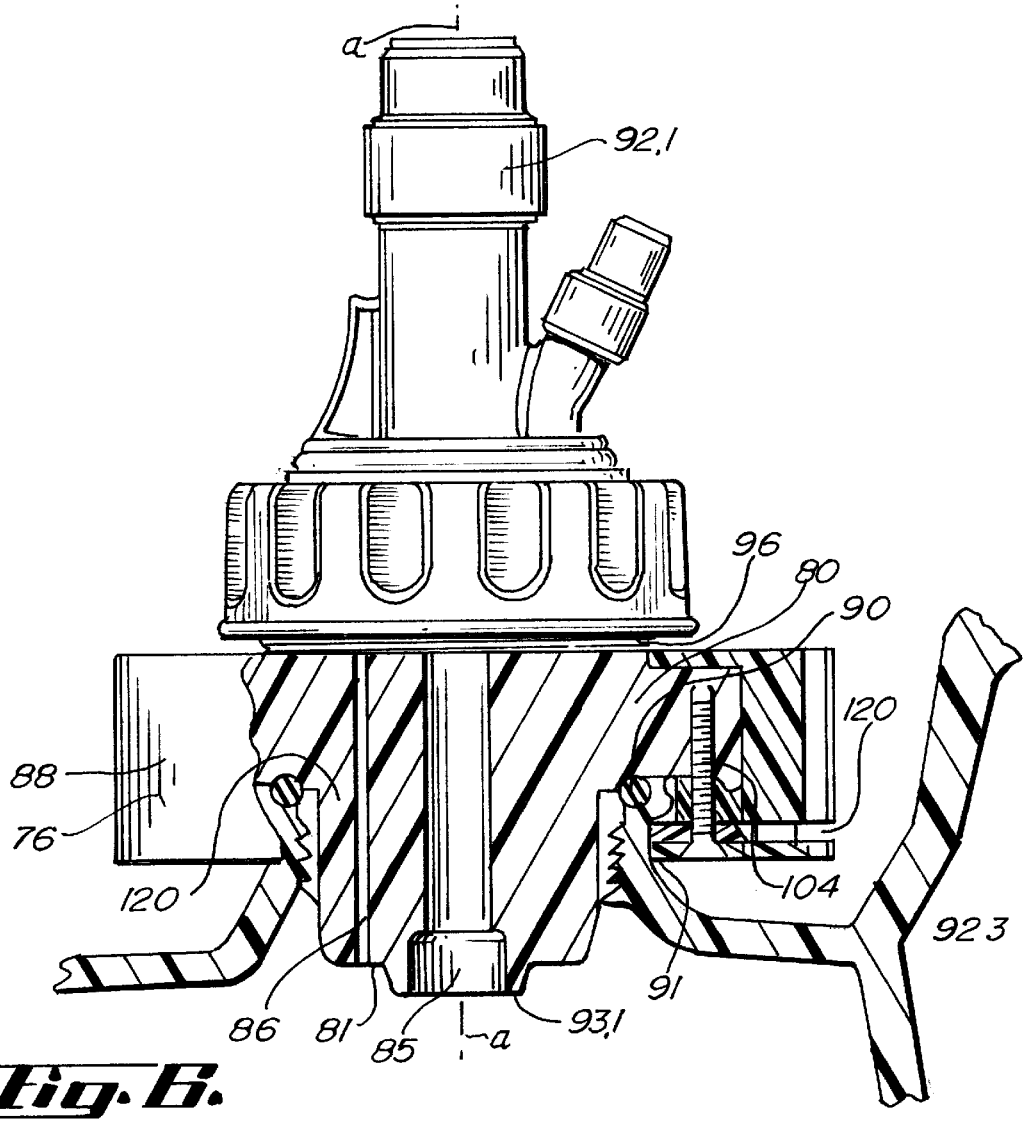
FIG. 6 is a elevational view of an adaptor in accord with the invention with a portion cut-away.
Figure 7:
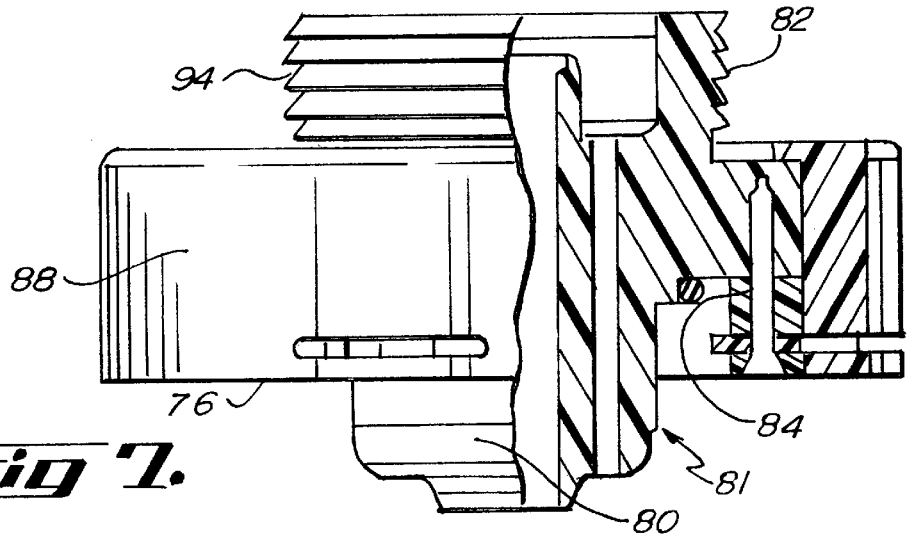
FIG. 7 is a perspective view of an adaptor and a dispense head in accord with the invention
Figure 8:
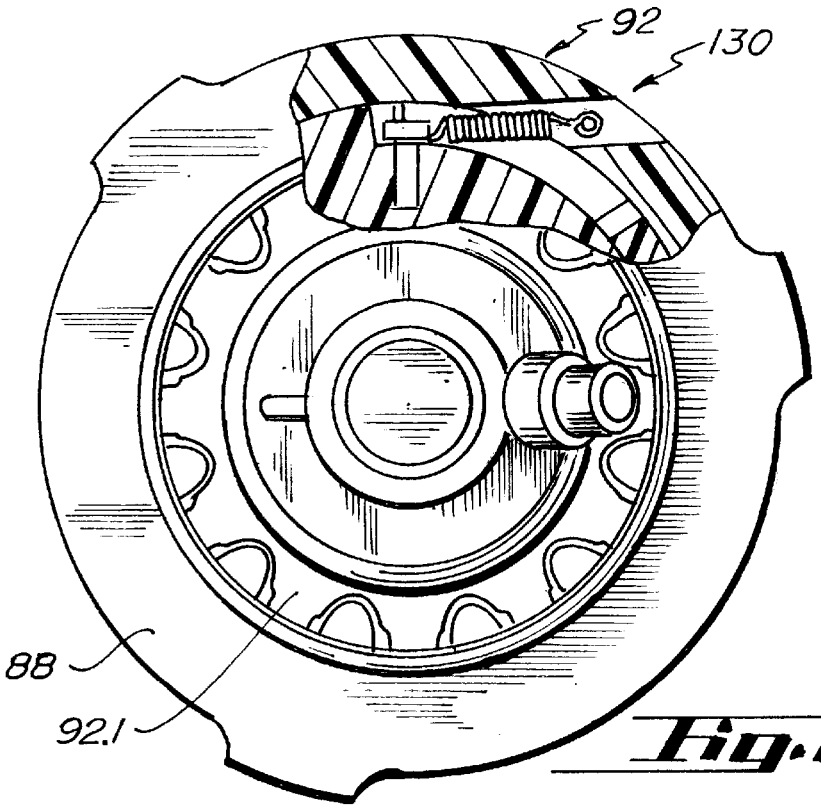
FIG. 8 is a plan view of an adaptor and dispense head of FIG. 7 with a section cut-away revealing a bias means.
Figure 9:
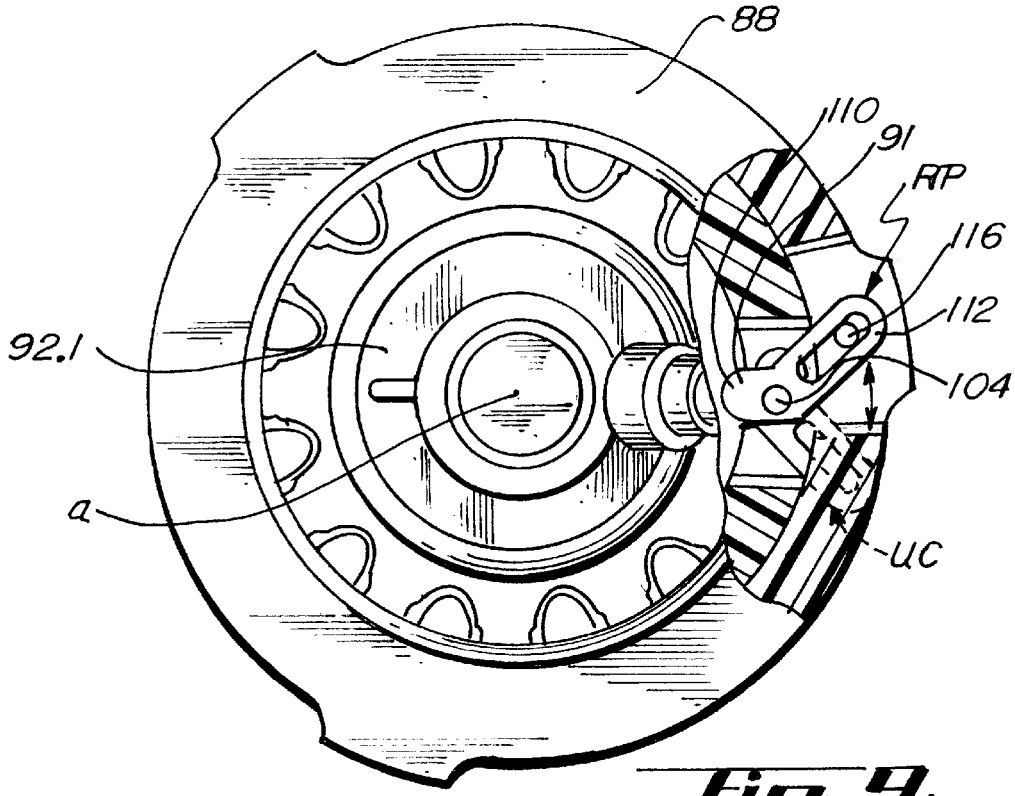
FIG. 9 is a plan view of an adaptor and dispense head of FIG. 7 with a section cut-away revealing a retainer member.

Referring to FIGS. 5, 6, 7, 8, and 9, an adaptor 76 according to the invention is illustrated and comprises principally a main body portion 80, a first coupling portion 81, a second coupling portion 82, a retaining ring 84, a central fluid flow conduit 85, a vent or air replacement conduit 86, a handle 88, a sealing portion 90 configured as an O-ring, retainer members 91, and bias means 92. FIGS. 6, 8, and 9 show the adaptor with a dispense head 92.1 attached at the second coupling 82. The dispense head couples to the adaptor, at a threaded neck 94 the main body portion, in the manner as illustrated in prior art FIG. 4 and the previously cited patents incorporated by reference. FIG. 6 illustrates the first coupling 81 of the adapter 76 attached to a drum 92.3 at a bung 92.4 shown in cross section and illustrating the interrelation of the components. The inner body portion 80 and the handle comprise an adaptor that provides an alternate mechanical coupling means to attach to the bungs. Not specifically illustrated, the adapter may utilize retainer members configured to engage exterior threads of a bung such as illustrated in prior art FIG. 2.

The handle 88 is configured as a concentric ring which rotates on the axis $\alpha$ of the coupling. The main body portion 80 provides a plurality of pivot means 104, suitably configured as a pin or screw, that pivotally retains the retainer members 91. Each retainer member has a retaining portion 110 and a sliding link portion 112. The sliding link is cooperatively coupled to an engagement member configured as a pin 116. As the handle is rotated with respect to the inner body portion, the pin 116 engaged with the sliding link causes the retainer member to pivot to move the member from the retaining position designated with the letter RP to the uncouple position designated UC. Suitable slots 120 are provided in the handle for movement of the retainer member therein.

Referring specifically to FIG. 8, a bias means 130 comprising a spring 132, anchored between the handle and the inner body portion biases the rotation of the handle to the position where the retainer members are in the retaining position RP. A plurality of such springs may be used.

The main body portion and the handle will typically be formed of PFA and may be injection molded or machined. The retainer ring 84 and handle 88 are not in contact with the fluids handled and therefore are suitably a less expensive plastic such as high density polyethylene. The retainer members may be preferably formed of stainless steel. Although the embodiment specifically illustrated shows a dispense head separate from the adaptor, such may be combined in a single unit.

Figure 10:
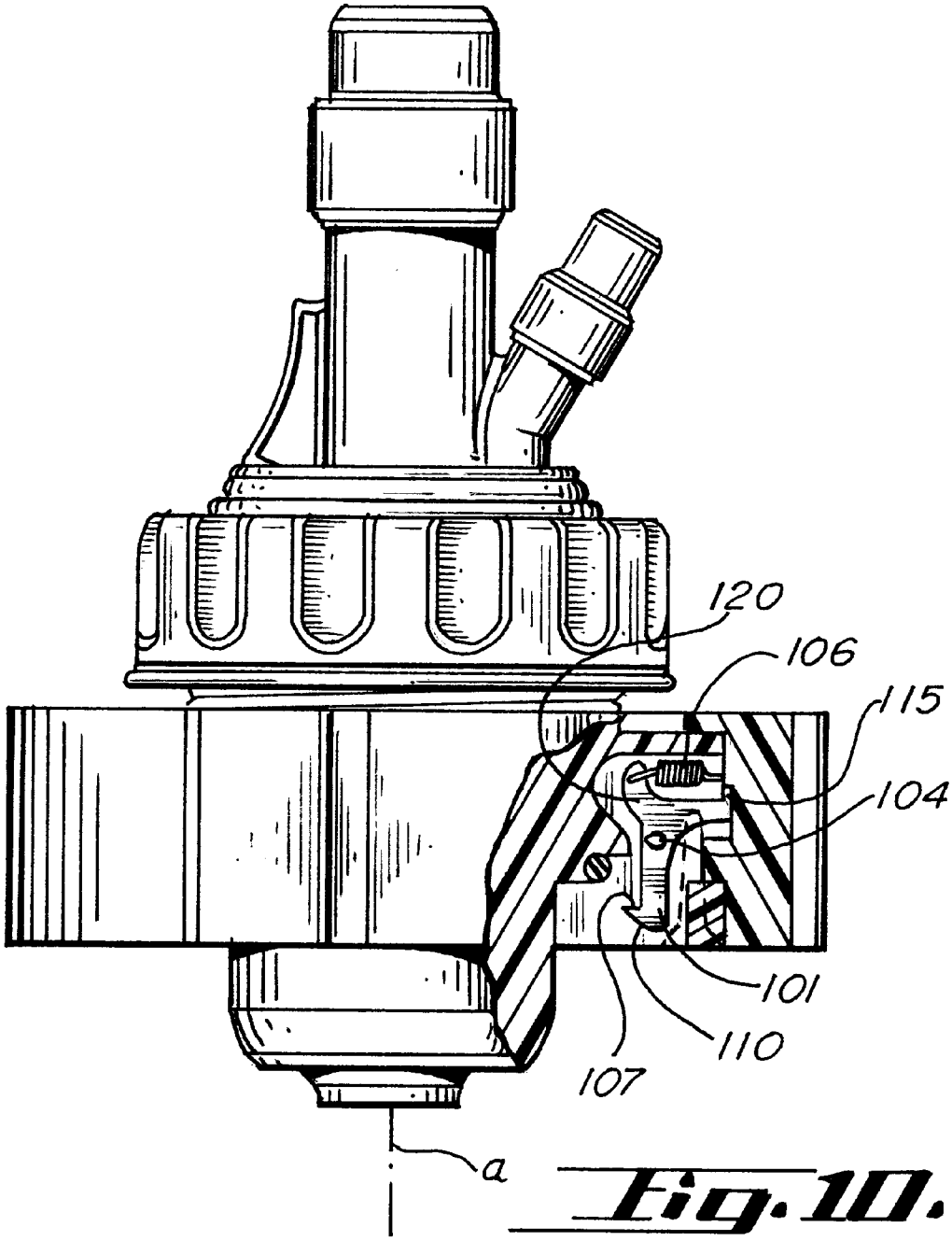
FIG. 10 is an elevational view of an alternate adaptor and dispense head with a portion cut-away disclosing a retainer member according to the invention.

Referring to FIG. 10 an alternate embodiment is illustrated wherein the retaining members 101 pivot about a horizontal axis and pivot within a plane coextensive with the axis a of the adaptor. The retaining member pivots about a pin 104 and has a spring 106 as a bias means that urges the engagement portion 107 of the retaining member to the retention position as is illustrated in this figure. The retaining member may have a cam surface 110 that causes the retaining member to pivot out of the retention position as the adaptor is lowered onto a bung. The handle may also have a cam surface 115 that upon a partial rotation of the handle urges the upper portion 120 of the retaining member inward, thus moving the engagement portion 107 outwardly.

The specific configurations shown are merely exemplary and alternative configurations may provide the same inventive aspects as specifically illustrated. In particular configurations, the retainer member may pivot outwardly to the retaining position rather than inwardly. Moreover, the retaining portion may be configured to cooperate with the structure on the bung to which it is attaching. As such, it could also secure to threads or recesses on the bung neck. Moreover, the retaining portions could be configured with cam surfaces to automatically lock onto the attachment structure of the bung without a separate manual rotation motion. The handle, although shown as a concentric member, could also be a gripping member with a pair of gripping handles that squeeze together to effect the motion of the retainer members.

What is claimed is:

1. An adaptor for handling caustic fluids and for connecting intermediate a dispense head and a bung coupling on a plastic drum, the bung comprising a neck with a lip, the dispense head comprising a fluoropolymer dispense head body, a rotatable nut attached to the dispense head body, and at least two conduits extending through said dispense head, one of said conduits comprising a centrally positioned fluid flow conduit, the adaptor comprising:

a fluoropolymer body having at least two conduits extending therethrough, one of said conduits comprising a central positioned fluid flow conduit, another of said conduits comprising a fluid flow conduit for coupling the contents of the plastic drum with an external environment, whereby venting or purging of the drum may be accomplished, a circular handle extending around said body, a plurality of retainer members, each retainer member pivotally attached to the body and wherein each retainer member has a retaining portion and a sliding link portion, each said retainer member linked to the handle whereby rotation of the handle moves said retainer members in a substantially radial direction outward body for disengagement of the retainer members with the bung neck portion.

2. The adaptor of claim 1 wherein the adaptor has an axis and wherein each retainer member pivots about a separate axis and wherein each axis is substantially parallel to the adaptor axis.

3. The adaptor of claim 1 wherein the adaptor has an axis and the wherein each retainer member pivots within a plane coextensive with the axis of the adaptor.

4. The adaptor of claim 1 wherein the handle has a bias member urging the rotation of the handle in a direction such that the retainer members are each urged inwardly toward their retention position.

5. The adaptor of claim 1 further comprising an O-ring extending around the fluoropolymer body and positioned for engaging the lip of the neck.

6. The combination of a drum, a dispense head, and an adaptor, the plastic drum having a bung having an upwardly extending plastic neck with a lip and a vertical axis, the dispense head having a vertical axis and comprising a fluoropolymer dispense head body, a rotatable nut attached to the dispense head body, and at least two conduits extending through said dispense head, one of said conduits comprising a centrally positioned fluid flow conduit, the dispense head connectable to a fluid supply source, the quick connect adaptor having a vertical axis and comprising a fluoropolymer adaptor body, a first coupling and a second coupling, the first coupling comprising a threaded neck and adapted to connect to the dispense head, the second coupling comprising a handle attached to and moveable with respect to the fluoropolymer adapter body, a plurality of retainer members pivotally connected to the adaptor body and pivotal into and out of a retention position with the plastic neck of the plastic drum, the retainer members operatively connected to the handle, the adaptor body having at least two conduits extending through said adaptor, one of said conduits comprising a centrally positioned fluid flow conduit.

7. The combination of claim 6 wherein the handle is circular shaped and extends around the adaptor body, and wherein the retainer members each pivot in a plane transverse to the axis of the neck, the dispense head, and the adaptor.

8. The combination of claim 6 wherein the handle is circular shaped and extends around the adaptor body, and wherein the retainer members pivot in a vertical plane coplanar to the axis of the adaptor.

9. The combination of claim 6 wherein the neck of the drum has internal threads and wherein the neck of the adaptor has external threads, wherein the dispense head nut has internal threads and wherein the dispense head nut screws onto the neck of the adaptor.

10. A liquid storage system comprising a drum and a coupling, the drum having a bung for connection of couplings, the bung comprising an upwardly extending neck, threads on said neck, a bung opening, an axis, a circumferentially and radially extending lip, the coupling having an inner body portion, at least two conduits extending therethrough, one of said conduits comprising a central positioned fluid flow conduit, another of said conduits comprising a fluid flow conduit for coupling the contents of the plastic drum with an external environment, whereby venting or purging of the drum may be accomplished, a plurality of retainer members pivotal with respect to the coupling and moveable into and out of an inwardly extending retention position, and a handle portion moveably attached to the coupling and mechanically linked to the plurality of retainer members for moving same into and out of the retention position.

11. The system of claim 10, wherein the retaining members pivot about an axis parallel to the coupling axis.

12. The system of claim 10, wherein the handle portion is rotatably and concentrically moveable with respect to the inner body and wherein each retainer member has a retaining portion and a sliding link portion and wherein the handle portion has a corresponding engagement portion to engage said sliding link portion such that as the handle portion is rotated, the engagement portion slides within the sliding link portion pivoting the retainer member retaining portion.

13. The liquid storage system of claim 10, wherein the inner body has a threaded portion for attachment of a further coupling, said further coupling having threads to provide the mechanical attachment to the inner body.

14. A liquid storage system comprising a drum and a coupling, the drum having a bung for connection of couplings, the bung comprising an upwardly extending neck, threads on said neck, a bung opening, an axis, a circumferentially and radially extending lip, the coupling having an inner body portion, at least two conduits extending therethrough, one of said conduits comprising a central positioned fluid flow conduit, another of said conduits comprising a fluid flow conduit for coupling the contents of the plastic drum with an external environment, whereby venting or purging of the drum may be accomplished, a plurality of retainer members pivotal with respect to the coupling and moveable into and out of an inwardly extending retention position, wherein the retainer members are biased to the retaining position, and a handle portion moveably attached to the coupling and mechanically linked to the plurality of retainer members for moving same into and out of the retention position.

15. An adaptor for providing a quick connect to a plastic drum having an integral bung, the bung having an upwardly extending neck, threads on said neck, a bung opening, an axis, and a circumferentially and radially extending lip, the adaptor having an inner body portion and a threaded portion for attachment of a further coupling, said coupling having at least two conduits extending therethrough, one of said conduits comprising a central positioned fluid flow conduit, another of said conduits comprising a fluid flow conduit for coupling the contents of the plastic drum with an external environment, whereby venting or purging of the drum may be accomplished, said further coupling having threads to provide the mechanical attachment to the inner body, the coupling further comprising a plurality of retainer members pivotal with respect to the coupling and moveable into and out of an inwardly extending retention position, and a handle portion moveably attached to the coupling and mechanically linked to the plurality of retainer members for moving same into and out of the retention position, the retainer members biased to the retention position.

16. The system of claim 15, wherein the retaining members pivot about an axis parallel to the coupling axis.

17. The system of claim 15, wherein the retainer members are each pivotally attached to the coupling.

18. The system of claim 15, wherein the handle portion is rotatably and concentrically moveable with respect to the inner body and wherein each retainer member has a retaining portion and a sliding link portion and wherein the handle portion has a corresponding engagement portion to engage said sliding link portion such that as the handle portion is rotated, the engagement portion slides with in the sliding link portion pivoting the retainer member retaining portion.

19. A chemically inert coupling portion for attachment to a drum bung, the bung formed of plastic and having an axis, and comprising an upwardly extending neck, threads on said neck, a bung opening axis, and a circumferentially and radially extending lip, the coupling comprising a main body portion that connects with the neck of the bung, a plurality of retainer members pivotal with respect to the coupling and moveable in a generally radial direction into and out of an inwardly extending retention position with respect to the lip, the retainer members biased to the retention position, and a handle portion moveably attached to the coupling and mechanically linked to the plurality of retainer members for moving each retainer member with respect to the retention position.

20. The coupling of claim 19, wherein the inner body portion is formed of PFA and wherein the retainer members are formed of stainless steel, wherein the handle is formed of plastic, and wherein the handle is circular shaped and extends around the inner body portion.

* * * * *

UNITED STATES PATENT AND TRADEMARK OFFICE

CERTIFICATE OF CORRECTION

PATENT NO. : 6,497,260 B2 
DATED : December 24, 2002
INVENTOR(S) : John Hennen and Ray Wolf It is certified that error appears in the above-identified patent and that said Letters Patent is hereby corrected as shown below:

Title page,
Item [75], should read:

-- [75] Inventors: John Hennen, Carver, MN (US); Ray Wolf, Chaska, MN (US) --

Signed and Sealed this

Twenty-seventh Day of May, 2003

JAMES E. ROGAN
*Director of the United States Patent and Trademark Office*